US008305309B2

(12) United States Patent
Tomida et al.

(10) Patent No.: US 8,305,309 B2
(45) Date of Patent: Nov. 6, 2012

(54) DISPLAY DEVICE WITH POWER SOURCE SUPPLY SCAN CIRCUITS AND DRIVING METHOD THEREOF

(75) Inventors: Masatsugu Tomida, Kanagawa (JP); Yukihito Iida, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 717 days.

(21) Appl. No.: 12/000,128

(22) Filed: Dec. 10, 2007

(65) Prior Publication Data

US 2008/0143650 A1 Jun. 19, 2008

(30) Foreign Application Priority Data

Dec. 19, 2006 (JP) ..... 2006-341180

(51) Int. Cl.
*G09G 3/30* (2006.01)

(52) U.S. Cl. ..... 345/77; 345/82

(58) Field of Classification Search ..... 345/76–77, 345/82; 315/169.3
See application file for complete search history.

(56) References Cited

U.S. PATENT DOCUMENTS

| | | | | |
|---|---|---|---|---|
| 2004/0149886 | A1* | 8/2004 | Matsueda et al. | 250/208.1 |
| 2004/0263508 | A1* | 12/2004 | Koyama et al. | 345/212 |
| 2005/0225518 | A1* | 10/2005 | Yamada et al. | 345/77 |
| 2006/0176250 | A1* | 8/2006 | Nathan et al. | 345/76 |
| 2007/0046592 | A1* | 3/2007 | Ono et al. | 345/77 |
| 2007/0063935 | A1* | 3/2007 | Yoshida | 345/76 |
| 2007/0216613 | A1* | 9/2007 | Ogura et al. | 345/76 |

FOREIGN PATENT DOCUMENTS

| | | | |
|---|---|---|---|
| JP | 05-113770 | A | 5/1993 |
| JP | 09-281928 | A | 10/1997 |
| JP | 11-295696 | | 10/1999 |
| JP | 2001-324958 | A | 11/2001 |
| JP | 2003-271095 | A | 9/2003 |
| JP | 2004-077567 | A | 3/2004 |
| JP | 2004-219624 | A | 8/2004 |
| JP | 2005-202365 | A | 7/2005 |
| JP | 2005-215249 | A | 8/2005 |
| JP | 2005-338152 | A | 12/2005 |
| JP | 2006-133542 | | 5/2006 |
| JP | 2006-235162 | A | 9/2006 |

OTHER PUBLICATIONS

Japanese Office Action issued Dec. 27, 2011 for corresponding Japanese Application No. 2006-341180.
Japanese Office Action issued Mar. 13, 2012 for corresponding Japanese Application No. 2006-341180.

* cited by examiner

*Primary Examiner* — Chanh Nguyen
*Assistant Examiner* — John Kirkpatrick
(74) *Attorney, Agent, or Firm* — Rader Fishman & Grauer, PLLC

(57) ABSTRACT

A display device includes a pixel array unit having pixels disposed in a matrix shape, each pixel including an electro-optical element, a write transistor for sampling and writing an input signal voltage, a holding capacitor for holding a signal voltage written by the write transistor, and a driver transistor for driving the electro-optical element in response to the signal voltage held in the holding capacitor. The display device further includes a scan circuit for selectively scanning each pixel in the pixel array unit at a row unit basis and a plurality of power source supply scan circuits for selectively supplying a first potential and a second potential lower than the first potential to a power supply line wired per each pixel row of the pixel array unit to supply current to the driver transistors, synchronously with scanning by the scan circuit.

6 Claims, 14 Drawing Sheets

(A) THRESHOLD VALUE CORRECTION:NO, MOBILITY CORRECTION:NO (B) THRESHOLD VALUE CORRECTION:YES, MOBILITY CORRECTION:NO (C) THRESHOLD VALUE CORRECTION:YES, MOBILITY CORRECTION:YES

DISPLAY DEVICE WITH POWER SOURCE SUPPLY SCAN CIRCUITS AND DRIVING METHOD THEREOF

CROSS REFERENCE TO RELATED APPLICATION

The present document contains subject matter related to Japanese Patent Application No. 2006-341180 filed in the Japanese Patent Office on Dec. 19, 2006, the entire content of which are incorporated herein by reference.

BACKGROUND OF THE INVENTION

1. Field of the Invention

The present invention relates to a display device, a driving method of the display device, and an electronic apparatus and, more particularly, to a flat panel type display device having pixels including electro-optical elements disposed in a matrix shape, a driving method for the display device and an electronic apparatus using the display device.

2. Description of Related Art

In the field of display devices for displaying video and text data, a flat type display device in which pixels (pixel circuits) having electro-optical elements are disposed in a matrix shape has been developed recently and researched for marketability. This flat type display device includes an organic electro luminescence (EL) display device using an electro-optical element of a so-called current drive type where an emission luminance changes in response to a value of current flowing through the device, for example, an organic EL element utilizing a phenomenon where optical emission occurs when an electric field is applied to an organic thin film, as an electro-optical element of a pixel.

The organic EL display device consumes only a small power because the organic EL element can be driven at an application voltage of 10 V or lower. Further, since the organic EL element is an emissive element, the organic EL display device is characterized by higher visual recognition of an image, no backlight, faster response speed of an element and the like, as compared to a liquid crystal display device which displays video and text data by controlling a light intensity of a light source (backlight) at each liquid crystal cell of a pixel.

Similarly to a liquid crystal display device, an organic EL display device can adopt as its driving method a simple (passive) matrix method and an active matrix method. Although a display device of a simple matrix type has a simple structure, it is associated with a problem that a large and high precision display device is hard to realize. Therefore, vigorous development has been conducted in recent years for a display device of the active matrix type which controls current flowing through an electro-optical element by an active element provided in the same pixel circuit of the electro-optical element, such as an insulated gate type field effect transistor (generally a thin film transistor (TFT)).

It is generally known that the I-V (current-voltage) characteristics of an organic EL element deteriorate with the passage of time (deterioration in time).

In a pixel circuit which uses an n-channel TFT as a transistor for current driving an organic EL element (hereinafter called a "driver transistor"), the organic EL element is connected to the source side of the driver transistor. Therefore, as the I-V characteristics of the organic EL element deteriorate with the passage of time, a gate-source voltage Vgs of the driver transistor changes, and accordingly the emission luminance of the organic EL element changes.

This phenomenon will be described more specifically. A source potential of the driver transistor is determined by an operation point of the driver transistor and organic EL element. As the I-V characteristics of the organic EL element deteriorate, the operation point of the driver transistor and organic EL element varies. Therefore, even if the same voltage is applied to the gates of the driver transistors, the source potentials of the driver transistors become different. Since a source-driver voltage Vgs of the driver transistor changes, the value of current flowing through the driver transistor changes. Since the value of current flowing through the organic EL element changes, an emission luminance of the organic EL element changes.

In a pixel circuit using a polysilicon TFT, in addition to the deterioration in time in the I-V characteristics of an organic EL element, because of the change of a threshold voltage Vth and a mobility μ with the passage of time and manufacturing process variation (variation of transistor characteristics), a threshold voltage Vth and a mobility μ of a driver transistor change with time, and become different for each pixel. If threshold voltages Vth and mobilities μ are different among driver transistors, there arises a variation of values of currents flowing through the driver transistors. Therefore, even if the same voltage is applied to the gates of driver transistors, emission luminances of organic EL elements become different among the pixels, thereby degrading the uniformity of a display screen even though the same voltage is applied to the gate of the driver transistor.

A pixel circuit is provided with a compensation function for a change in the characteristics of an organic EL element and a correction function for a change in the threshold voltage Vth and mobility μ of a driver transistor, so as to maintain constant the emission luminance of the organic EL element, without being adversely affected by the deterioration in time in the I-V characteristics of the organic EL element and in the threshold voltage Vth and mobility μ of the driver transistor (e.g., refer to Patent Document 1: Japanese Patent Application Publication No. 2006-133542).

SUMMARY OF THE INVENTION

According to the related art techniques described in Patent Document 1, each pixel circuit is provided with the compensation function for a change in the characteristics of an organic EL element and a correction function for a change in the threshold voltage Vth and mobility μ of a driver transistor, so as to maintain constant the emission luminance of the organic element, without being adversely affected by the deterioration in time in the I-V characteristics of the organic EL element and in the threshold voltage Vth and mobility μ of the driver transistor. However, the number of components constituting the pixel circuit becomes large, hindering a pixel size from being made fine.

In order to reduce the number of components and wirings constituting a pixel circuit, adopting an approach to controlling emission/non-emission of an organic EL element by sharing one wiring with a power supply wiring for supplying a power source potential to the pixel circuit and switching the power source potential to be supplied to the pixel circuit was considered.

However, if one wiring is shared with the power source supply wiring in the pixel circuit having an organic EL element of a current drive type, a luminance difference appears at each video line (the details will be described later). Because, for example, as shown in FIG. 12, in displaying an image having a luminance level very different at each line, such as displaying a black stripe in a partial area of the display screen, the total current flowing through each power supply line is different between lines A and B, and this difference causes a luminance difference.

Accordingly, it is desirable to provide a display device capable of displaying an image of high quality, even if there is a difference between the currents necessary for emission at each video line, by reducing the luminance difference at each video line caused by the current difference, a driving method for the display device, and an electronic apparatus using the display device. The present invention is made in view of the above.

According to an embodiment of the present invention, a display device includes: a pixel array unit having pixels disposed in a matrix shape, each pixel including an electro-optical element, a write transistor for sampling and writing an input signal voltage, a holding capacitor for holding a signal voltage written by the write transistor, and a driver transistor for driving the electro-optical element in response to the signal voltage held in the holding capacitor; and a scan circuit for selectively scanning pixels of the pixel array unit on a row unit basis. In the display device, a plurality of power source supply scan circuits selectively supply a first potential and a second potential lower than the first potential to each power supply line to supply current to the driver transistors, synchronously with scanning by the scan circuit.

In the display device configured as above and an electronic apparatus having the display device, pixels are driven in such a manner that a plurality of power source supply scan circuits selectively supply the first potential and the second potential as power potential to each power supply line, synchronously with scanning by the scan circuit. For example, if two power source supply scan circuits are used, current flowing through pixels in the row unit basis from one power source supply scan circuit via power supply lines is halved, as compared to the case in which one power source supply scan circuit is provided. As compared to one power source supply scan circuit, it is hard for a luminance difference at each video line to appear, because a voltage drop becomes small in the power source supply scan circuits; the voltage drop is caused by current supplied to pixels on the row unit basis.

BRIEF DESCRIPTION OF THE DRAWINGS

FIG. 14A is a perspective view as viewed from the front side; and FIG. 14B is a perspective view as viewed from the back side.

FIG. 17A is a front view in an open state; FIG. 17B is a side view of FIG. 17A; FIG. 17C is a front view in a closed state; FIG. 17D is a left side view; FIG. 17E is a right side view; FIG. 17F is a top view; and FIG. 17G is a bottom view.

DETAILED DESCRIPTION OF THE EMBODIMENTS

Embodiments of the present invention will be described in detail with reference to the accompanying drawings.

Figure 1:
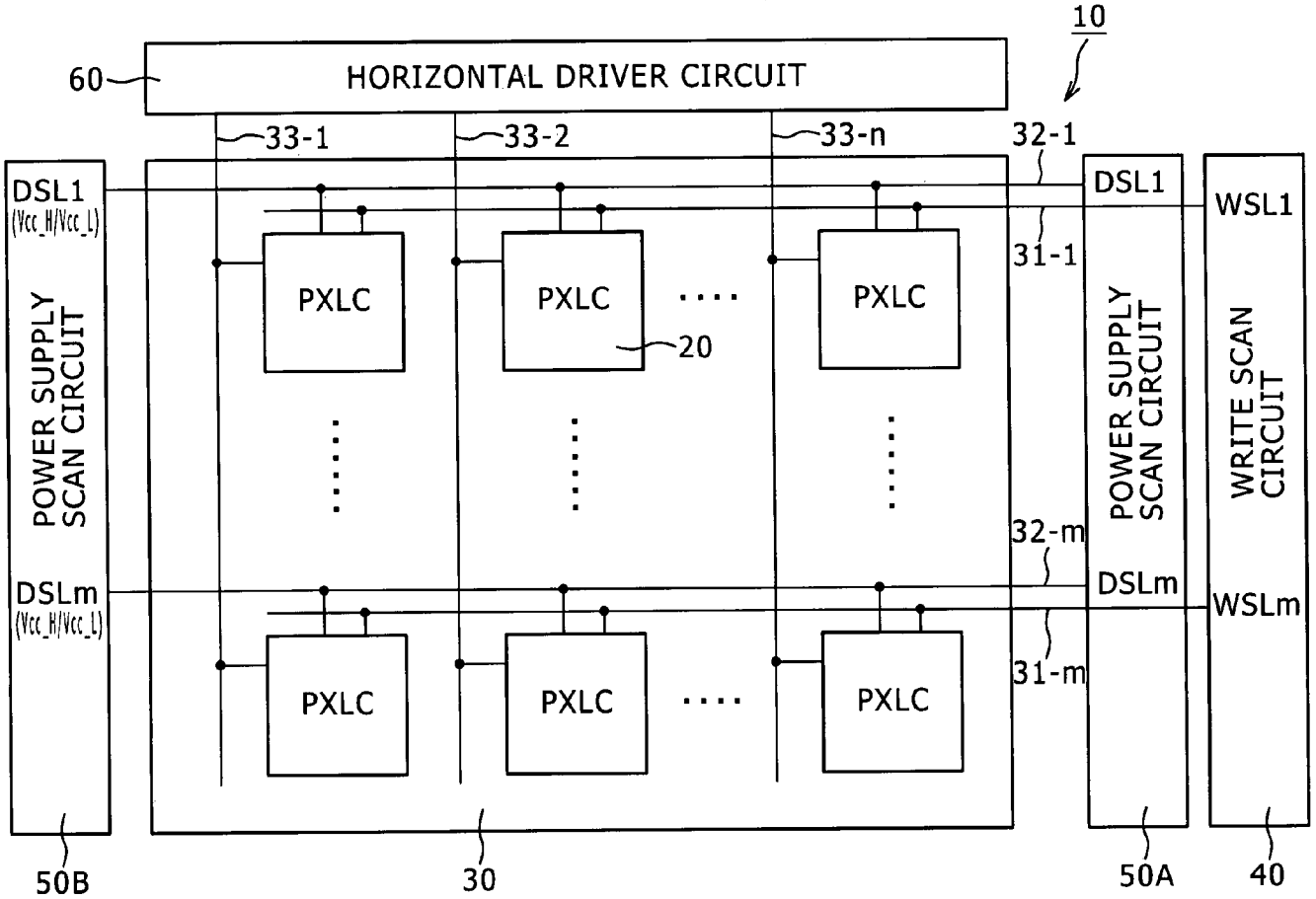
FIG. 1 is a system configuration diagram showing briefly the structure of an organic EL display device according to an embodiment of the present invention.

FIG. 1 is a system configuration diagram showing briefly the structure of an active matrix type display device according to an embodiment of the present invention. A description will be given by taking as an example an active matrix type, organic EL display device which uses an organic EL element as a pixel light emitting element, an electro-optical element of a current drive type that a luminance changes in response to a value of current flowing through the device.

As shown in FIG. 1, an organic EL display device 10 of this embodiment includes a pixel array unit 30 having pixels (PXLC) 20 two-dimensionally disposed in a matrix shape and a drive unit disposed in peripheral areas of the pixel array unit 30. The drive unit drives each pixel 20 and has a write scan circuit 40, a plurality of (in this example, two) power source supply scan circuits 50A and 50B and a horizontal driver circuit 60.

The pixel array unit 30 has an m-row-n-column layout, wired scan lines 31-1 to **31-*m* and wired power supply lines 32-1 to 32-*m* for each pixel row, and wired signal lines 33-1 to 33-*n*** for each pixel column.

The pixel array unit 30 is usually formed on a transparent insulating substrate, such as a glass substrate, and has a flat type panel structure. Each pixel 20 of the pixel array unit 30 may be formed by using an amorphous silicon thin film transistor (TFT) or a low temperature polysilicon TFT. If a low temperature polysilicon TFT is used, the scan circuit 40, power source supply scan circuits 50A and 50B and the horizontal driver circuit 60 also may be mounted on the panel (substrate) on which the pixel array unit 30 is formed.

The write scan circuit 40 is formed of a shift register or the like, and performs line sequential scanning of the pixels 20 in the unit of line by sequentially supplying scan signals WSL1 to WSLm to the scan lines 31-1 to **31-*m*, while a video signal is supplied to each pixel 20 of the pixel array unit 30**.

The power source supply scan circuits 50A and 50B include shift registers or the like, and are disposed, for example, on both sides of the pixel array unit 30 by sandwiching the pixel array unit. Synchronously with the line sequential scanning by the write scan circuit 40, power supply line potentials DSL1 to DSLm, each switching at a first potential Vcc_H and a second potential Vcc_L lower than the first potential Vcc_H, are supplied to the power supply lines 32-1 to **32-*m* from both sides of the pixel array unit 30. The second potential Vcc-L is sufficiently lower than a reference potential Vo supplied from the horizontal driver circuit 60**.

The horizontal driver circuit 60 selects properly either video signal voltages Vsig corresponding to luminance information supplied from a signal supply source (not shown) or the reference potential Vo, and performs writing per row (line) unit to each pixel 20 of the pixel array unit 30 via the signal lines 33-1 to **33-*n*. Namely, the horizontal driver circuit 60** adopts a driving type of simultaneous line sequential writing of the signal voltages Vsig in the unit of row (line).

(Pixel Circuit)

Figure 2:
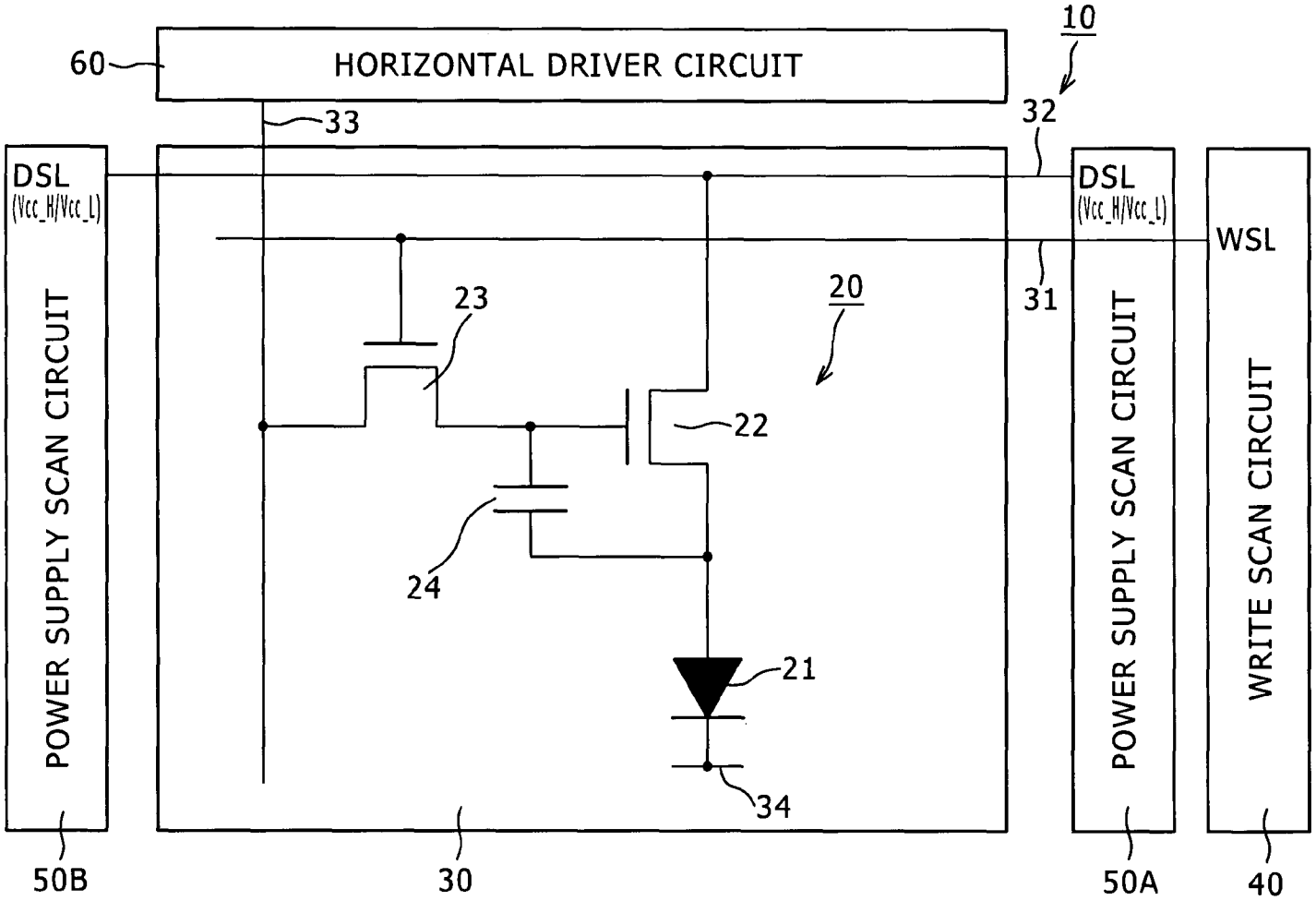
FIG. 2 is a circuit diagram showing an example of a specific structure of a pixel (pixel circuit).

FIG. 2 is a circuit diagram showing a specific example of the structure of the pixel (pixel circuit) 20. As shown in FIG. 2, the pixel 20 has as its light emitting element an electro-optical element, such as an organic EL element 21 of a current drive type, changing an emission luminance in response to the value of current flowing through the element. In addition to the organic EL element 21, the pixel also has a driver transistor 22, a write transistor 23 and a holding capacitor 24.

A n-channel type TFT is used for the driver transistor 22 and the write transistor 23. A combination of the conductivity types of the driver transistor 22 and the write transistor 23 is only illustrative and is not limited thereto.

The organic EL element 21 has a cathode electrode connected to a common power supply line 34 wired in common to all pixels 20. A source of the driver transistor 22 is connected to an anode electrode of the organic EL element 21, and a drain thereof is connected to a corresponding power supply line 32 (32-1 to **32-*m*). A gate of the write transistor 23 is connected to a corresponding scan line 31 (31-1 to 31-*m*), a source is connected to the signal line 33 (33-1 to 33-*n*), and a drain thereof is connected to a gate of the driver transistor 22. One end of the holding capacitor 24 is connected to the gate of the driver transistor 22, and the other end thereof is connected to the source of the driver transistor 22 (to the anode electrode of the organic EL element 21**).

In the pixel 20 constructed as above, the write transistor 23 becomes conductive in response to the scan signal WSL applied to the gate from the write scan circuit 40 via the scan line 31, and the video signal voltage Vsig corresponding to luminance information supplied from the horizontal driver circuit 60 via the signal line 33 or the reference voltage V0 are sampled so as to be written into the pixel 20. This written signal voltage Vsig or reference voltage V0 is held in the holding capacitor 24.

The driver transistor 22 is supplied with current from the power source line 32 when a potential DSL of the power source line 32 (32-1 to **32-*m*) is at the first potential Vcc_H, and drives the organic EL element 21 by supplying a drive current having a value corresponding to the signal voltage Vsig held in the holding capacitor 24 to the organic EL element 21**.

(Pixel Structure)

Figure 3:
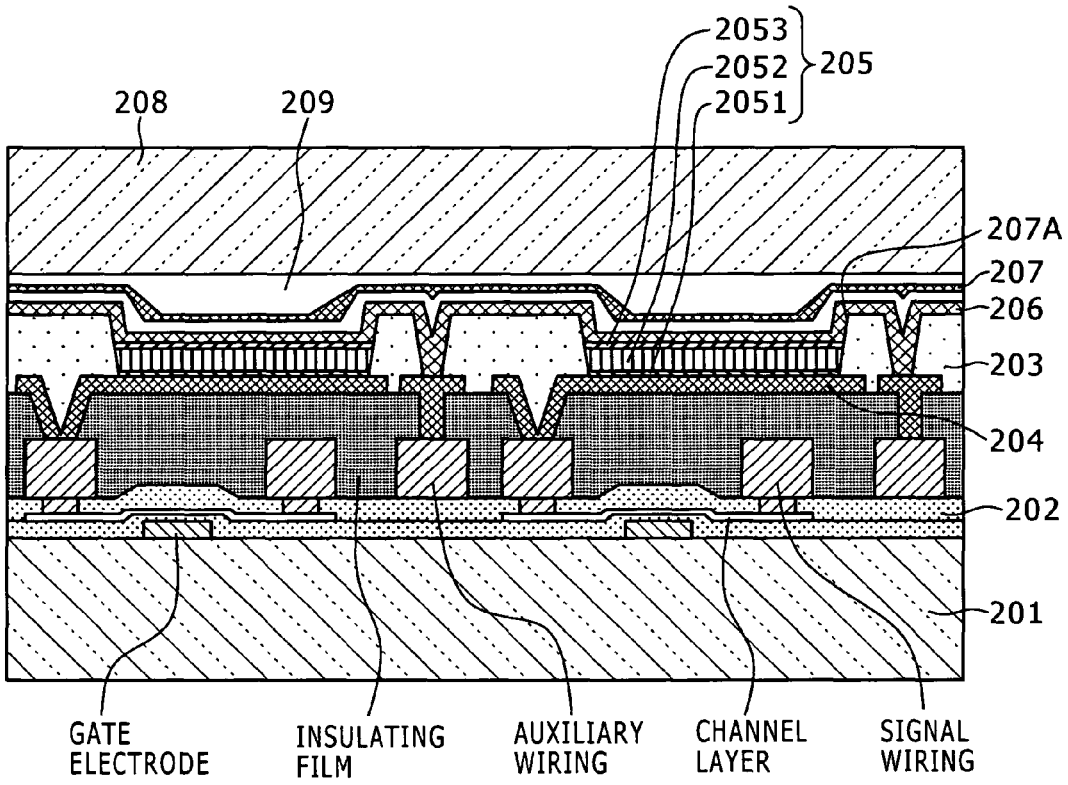
FIG. 3 is a cross sectional view showing an example of the structure of a pixel.

FIG. 3 shows an example of the cross sectional structure of the pixel 20. As shown in FIG. 3, the pixel 20 has a structure in which an insulating film 202 and a window insulating film 203 are formed above a glass substrate 201 on which the pixel circuit including the driver transistor 22, the write transistor 23 and the like are formed, and the organic EL element 21 is formed in a recess 207A of the window insulating film 23.

The organic EL element 21 includes an anode electrode 204 made of metal or the like and formed on the bottom of the recess 207A of the window insulating film 203, an organic layer (an electron transport layer, an emission layer, a hole transport layer/a hole injection layer) 205 formed on the anode electrode 204, and a cathode electrode 206 made of a transparent conductive film or the like and formed on the organic layer 205 in common to all pixels.

The organic layer 208 of the organic EL element 21 is formed by sequentially depositing on the anode electrode 204 a hole transport layer/a hole injection layer 2051, an emission layer 2052, an electron transport layer 2053 and an electron injection layer (not shown). Under current driving of the driver transistor 22 shown in FIG. 2, current flows through the organic layer 205 via the anode electrode 204 from the driver transistor 22, and thus electrons and holes are recombined in the emission layer 2052 of the organic layer 205 to emit light.

As shown in FIG. 3, after the organic EL element 21 for each pixel is formed above the glass substrate 201 on which the pixel circuits are formed, with the insulating film 202 and the window insulating film 203 in between, a sealing substrate 208 is bonded with adhesive 209 with a passivation film 207 in between. The sealing substrate 208 seals the organic EL element 21 to form an organic EL display panel.

(Threshold Value Correction Function)

After the write transistor 23 becomes conductive and while the horizontal driver circuit 60 supplies the reference potential Vo to the signal lines 33 (33-1 to **33-*n*), the power source supply scan circuits 50A and 50B switch the potential DSL at the power supply line 32 between the first potential Vcc_H and second potential Vcc_L. With this switching of the potential DSL at the power supply line 32, a voltage corresponding to a threshold voltage Vth of the driver transistor 22 is held in the holding capacitor 24**.

Because of the following reason, the voltage corresponding to a threshold voltage Vth of the driver transistor 22 is held in the holding capacitor 24. The transistor characteristics, such as a threshold voltage Vth, a mobility μ and the like, of the driver transistor 22 vary at each pixel because of a variation in manufacture processes and deterioration in time in driver transistors 22. This variation of the transistor characteristics changes a drain-source current (drive current) Ids of each pixel, even if the same gate potential is applied to each driver transistor 22, appearing as a variation in emission luminances. In order to cancel (correct) the influence of a variation in the threshold voltage Vth at each pixel, the voltage corresponding to the threshold voltage Vth is held in the holding capacitor 24.

The threshold voltage Vth of the driver transistor 22 is corrected in the following manner. Namely, by holding in advance the threshold voltage Vth in the holding capacitor 24, the threshold voltage Vth of the driver transistor 22 is cancelled out by the voltage corresponding to the threshold voltage Vth held in the holding capacitor 24; in other words, the threshold voltage Vth can be corrected.

The threshold value correction function has been described above. An emission luminance of the organic EL element 21 can be maintained constant without being affected by a variation even if there are a variation in the threshold voltage Vth and deterioration in time at each pixel, due to the threshold value correction function. The principle of threshold value correction will be described later in detail.

(Mobility Correction Function)

In addition to the threshold value correction function, the pixel 20 shown in FIG. 2 has a mobility correction function. Namely, during a period while the write transistors 23 become conductive in response to the scan signal WSL (WSL1 to WSLm) outputted from the write scan circuit 40, i.e., and during a mobility correction period, while the horizontal driver circuit 60 supplies the video signal voltages Vsig to the signal lines 33 (33-1 to **33-*n*), mobility correction for cancelling out a dependency of the drain-source current Ids of the driver transistor 22 to the mobility μ is performed while the signal voltages Vsig are held in the holding capacitors 24**. The specific principle and operation of mobility correction will be described later.

(Bootstrap Function)

The pixel 20 shown in FIG. 2 also has a bootstrap function. Namely, a supply of the scan signal WSL (WSL1 to WSLm) to the scan line 31 (**31-*a* to 31-*m*) is released at the stage when the signal voltage Vsig is held in the holding capacitor 24, and the horizontal driver circuit 60 makes the write transistor 23 not conductive to electrically disconnect the gate of the driver transistor 22 from the signal line 33 (33-1 to 33-*n*). The gate potential Vg follows a change in the source potential Vs of the driver transistor 22, and thus the gate-source voltage Vgs of the driver transistor 22** can be maintained constant.

(Circuit Operation)

Next, the circuit operation of the organic EL display device 10 of the embodiment will be described with reference to a timing chart shown in FIG. 4 and illustrative operation diagrams shown in FIGS. 5 and 6. In the illustrative operation diagrams shown in FIGS. 5 and 6, for the purposes of drawing simplicity the write transistor 23 is represented by a switch symbol. Since the organic EL element 21 has parasitic capacitance, this parasitic capacitance Cel is drawn additionally.

Figure 4:
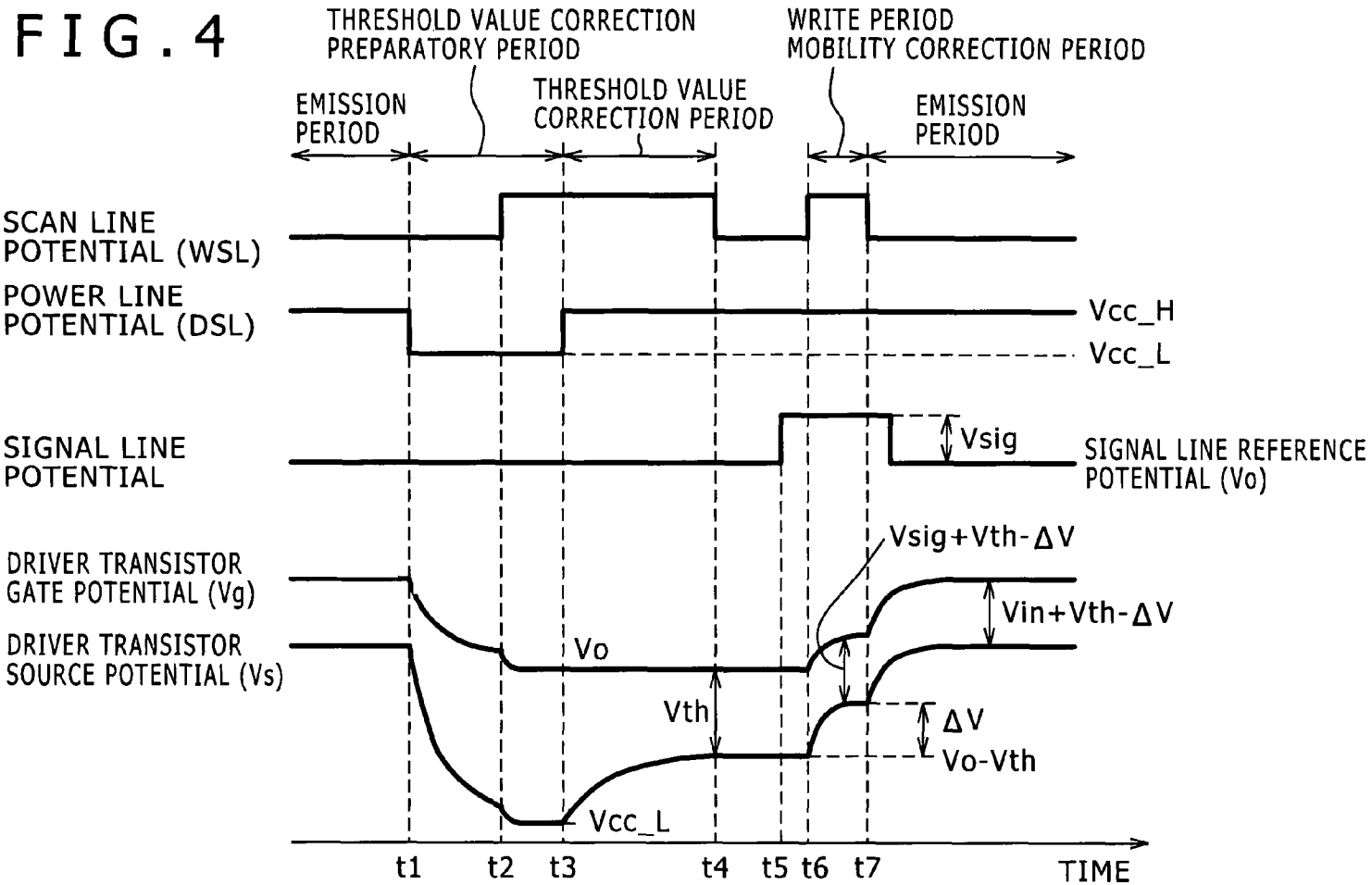
FIG. 4 is a timing chart illustrating the operation of the organic EL display device according to the embodiment of the present invention.

The timing chart shown in FIG. 4 shows a change in the potential (scan signal) WSL at the scan line 31 (31-1 to **31-*m*), a change in the potential DSL at the power supply line 32 (32-1 to 32-*m*) and a change in the gate potential Vg and source potential Vs of the driver transistor 22**, respectively, in 1H (H is a horizontal scan period) by using a common time axis.

<Emission Period>

Figure 5A:
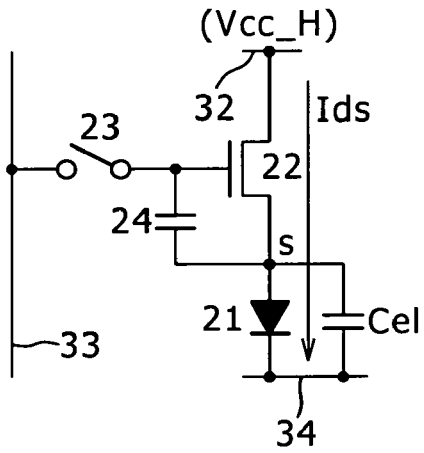
FIGS. 5A to 5D are diagrams illustrating circuit operations of the organic EL display device according to the embodiment of the present invention.

In the timing chart shown in FIG. 4, the organic EL element 21 is in an emission state during the period at or before time t1 (emission period). During the emission period, the potential DSL at the power source line 32 is the high potential Vcc_H (first potential). As shown in FIG. 5A, since the drive current (drain-source current) Ids is supplied from the power source line 32 to the organic EL element 21 via the driver transistor 22, the organic EL element 21 emits light at a luminance corresponding to the drive current Ids.

<Threshold Value Correction Preparatory Period>

Figure 5B:
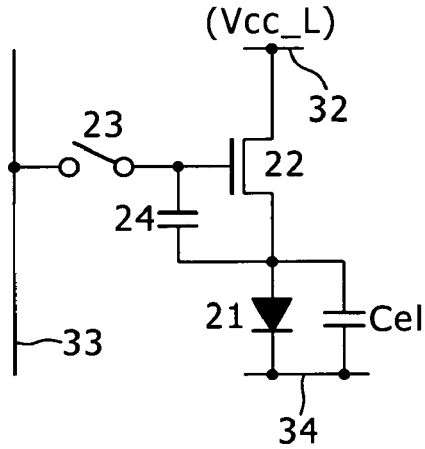

At a time t1, a new field in line sequential scanning enters. As shown in FIG. 5B, when the potential DSL at the power supply line 32 transits from the high potential Vcc_H to the low potential Vcc_L (second potential) sufficiently lower than the reference potential Vo at the signal line 33, the source potential Vs of the driver transistor 22 starts lowering toward the low potential Vcc_L.

Figure 5C:
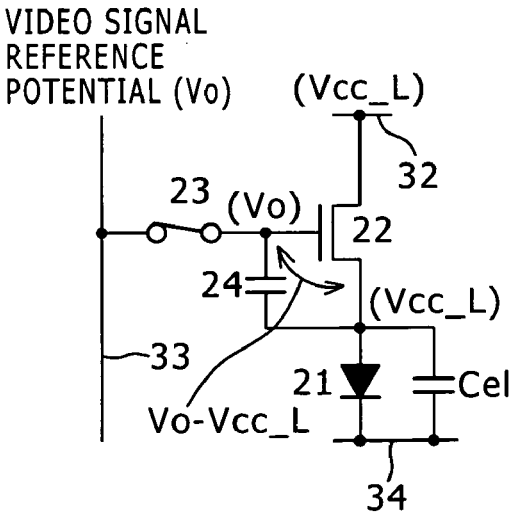

Next, at a time t2, the write scan circuit 40 outputs the scan signal WSL, and the potential WSL at the scan line 31 transits to the high potential side such that the write transistor 23 becomes conductive as shown in FIG. 5C. Since the horizontal driver circuit 60 supplies the reference potential Vo to the signal line 33 during this period, the gate potential Vg of the driver transistor 22 becomes the reference potential Vo. The source potential Vs of the driver transistor 22 is the potential Vcc-L sufficiently lower than the reference potential Vo.

It is assumed herein that the low potential Vcc_L is set in such a manner that the gate-source voltage Vgs of the driver transistor 22 becomes larger than the threshold voltage Vth of the driver transistor 22. By initializing the driver transistor 22 to have the reference potential Vo as the gate potential Vg and the low potential Vcc-L as the source potential Vs, preparation for a threshold voltage correction operation is completed.

<Threshold Value Correction Period>

Figure 5D:
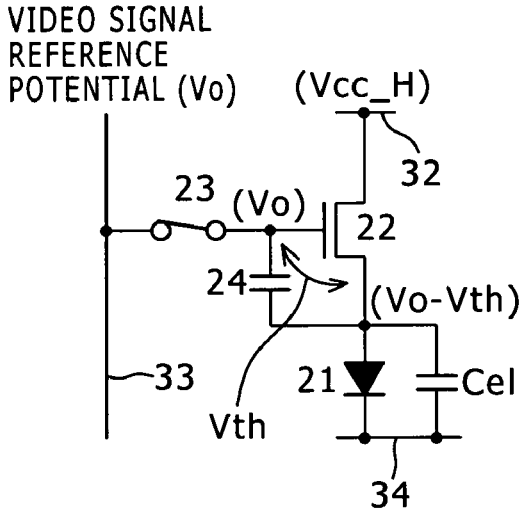

Next, as shown in FIG. 5D, at a time t3 when the potential DSL at the power supply line 32 switches from the low potential Vcc_L to the high potential Vcc_H, the source potential Vs of the driver transistor 22 starts rising. The gate-source voltage Vgs of the driver transistor 22 becomes eventually the threshold voltage Vth of the driver transistor 22, and a voltage corresponding to the threshold voltage Vth is written in the holding capacitor 24.

For the purposes of convenience the period while the voltage corresponding to the threshold voltage Vth is written in the holding capacitor 24 is called a threshold value correction period. In order to make current flow mainly through the holding capacitor 24 and not through the organic EL element 21 during the threshold value correction period, it is assumed that the potential at the common power supply line 34 is set to cut off the organic EL element 21.

Figure 6A:
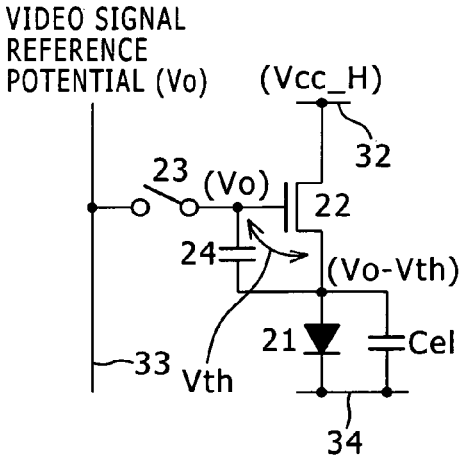
FIGS. 6A to 6D are diagrams illustrating other circuit operations of the organic EL display device according to the embodiment of the present invention.

Next, as shown in FIG. 6A, at a time t4 when the potential WSL at the scan line 31 transits to the low potential side, the write transistor 23 becomes unconductive. Although the gate of the driver transistor 22 enters a floating state at this time, the driver transistor 22 is in a cut-off state because the gate-source voltage Vgs is equal to the threshold voltage Vth of the driver transistor 22. Therefore, the drain-source current Ids will not flow.

<Write Period/Mobility Correction Period>

Figure 6B:
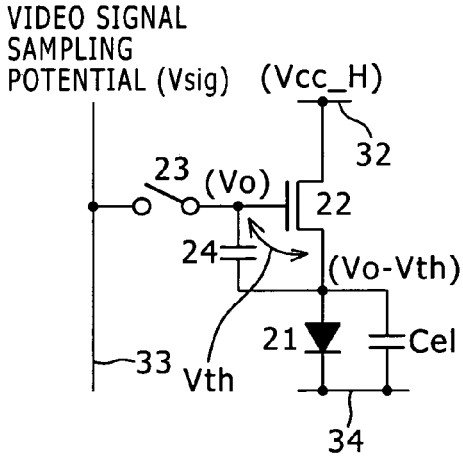
Figure 6C:
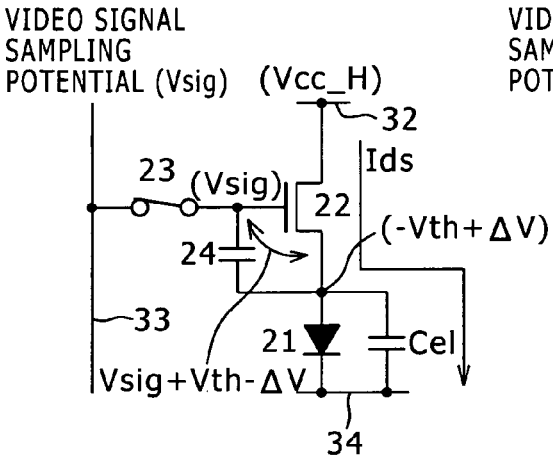

Next, as shown in FIG. 6B, at a time t5, the potential at the signal line 33 is switched from the reference potential Vo to the video signal voltage Vsig. In succession, at a time t6 when the potential WSL at the scan line 31 transits to the high potential side, the write transistor 23 becomes conductive and samples the video signal voltage Vsig, as shown in FIG. 6C.

With this sampling of the signal voltage Vsig by the write transistor 23, the gate potential Vg of the drive transistor 22 becomes the signal voltage Vsig. Since the organic EL element 21 is in the cut-off (high impedance) state at this time, the drain-source current Ids of the driver transistor flows into the parasitic capacitor Cel of the organic EL element 21 to start charging the parasitic capacitor Cel.

Charging the parasitic capacitor Cel of the organic EL element 21 makes the source potential Vs of the driver transistor 22 start rising, and the gate-source voltage Vgs of the driver transistor 22 becomes eventually Vsig+Vth−/ΔV. Namely, a rise ΔV of the source potential Vs is subtracted from the voltage (Vsig+Vth) held in the holding capacitor 24, in other words, to discharge the charges in the holding capacitor 24 and conduct negative feedback. The rise ΔV of the source potential Vs represents therefore a negative feedback amount.

With this negative feedback of the drain-source current Ids flowing through the driver transistor 22 to the gate input of the driver transistor, i.e., to the gate-source voltage Vgs, mobility correction is realized for eliminating a dependency of the drain-source current Ids of the driver transistor 22 upon a mobility μ, i.e., for correcting a variation in the mobility μ of each pixel.

More specifically, the higher the video signal voltage Vsig is, the larger the drain-source current Ids becomes, and an absolute value of the negative feedback amount (correction amount) ΔV becomes larger. Therefore, it is possible to conduct the mobility correction in accordance with an emission luminance level. Assuming that the video signal voltage Vsig is constant, the higher the mobility μ of the driver transistor 22 is, the larger the absolute value of the negative feedback amount ΔV is. It is therefore possible to eliminate the variation in the mobility μ of each pixel.

<Emission Period>

Figure 6D:
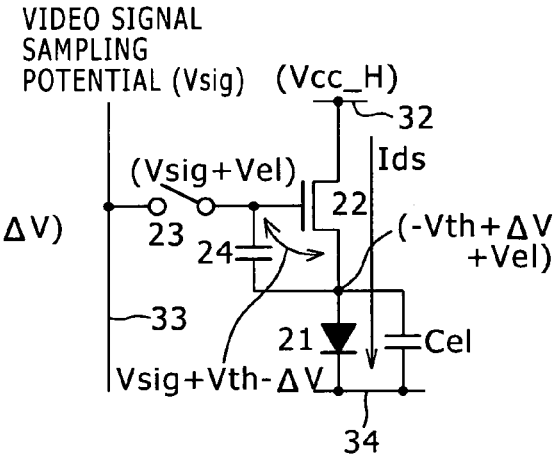

Next, at a time t7 when the potential WSL at the scan line 31 transits to the low potential side, the write transistor 23 becomes unconductive (off) as shown in FIG. 6D. The gate of the driver transistor 22 is therefore disconnected from the signal line 33. At the same time, the drain-source current Ids starts flowing through the organic EL element 21, so that the anode potential of the organic EL element 21 rises in accordance with the drain-source current Ids.

A rise in the anode potential of the organic EL element 21 is nothing but a rise in the source potential Vs of the driver transistor 22. As the source potential Vs of the driver transistor 22 rises, the gate potential Vg of the driver transistor 22 rises correspondingly because of a bootstrap operation of the holding capacitor 24. A rise amount of the gate potential Vg is equal to a rise amount of the source potential Vs. Therefore, the gate-source voltage Vgs of the driver transistor 22 is maintained constant at Vin+Vth−ΔV during the emission period.

(Principle of Threshold Value Correction)

A description of the principle of threshold value correction of the driver transistor 22 will be given first. The driver transistor 22 is designed to operate in a saturated region so that the drive transistor operates as a constant current source. A constant drain-source current (drive current) Ids given by the following formula (1) is supplied from the drive transistor 22 to the organic EL element 21:

$$Ids=(1/2)\cdot\mu(W/L)Cox(Vgs-Vth)^2 \quad (1)$$

where W is a channel width of the driver transistor 22, L is a channel length and Cox is a gate capacitance per unit area.

Figure 7:
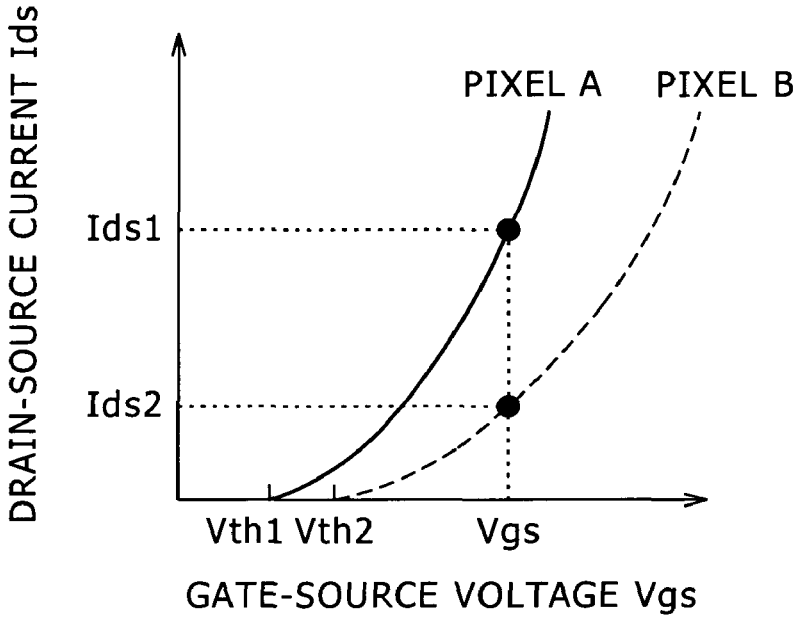
FIG. 7 is a diagram showing the characteristics of a driver transistor explaining an issue associated with a variation of a threshold voltage Vth.

FIG. 7 is a diagram showing the characteristics of the driver transistor 22 regarding a relation between the drain-source current Ids and the gate-source voltage Vgs. As seen from the graph, if a variation in the threshold voltage Vth of each driver transistor 22 is not corrected, the drain-source current Ids is Ids1 at a gate-source voltage Vgs when the threshold voltage Vth is Vth1, whereas the drain-source current Ids is Ids2 (Ids2<Ids1) at the gate-source voltage Vgs when the threshold voltage Vth is Vth2 (Vth2>Vth1). Namely, as the threshold voltage Vth of the driver transistor 22 varies, the drain-source current Ids varies even if the gate-source voltage Vgs is constant.

In contrast, in the pixel (pixel circuit) 20 having the structure described above, the gate-source voltage Vgs of the driver transistor 22 is Vin+Vth−ΔV during the emission period, as described earlier. By substituting this gate-source voltage into the formula (1), the drain-source current Ids can be expressed by the following formula (2):

$$Ids=(1/2)\cdot\mu(W/L)Cox(Vin-\Delta V)^2 \quad (2)$$

Namely, since the term of the threshold voltage Vth of the driver transistor 22 is cancelled out, the drain-source current Ids supplied from the driver transistor 22 to the organic EL element 21 does not depend upon the threshold value Vth of the driver transistor 22. Therefore, even if the threshold voltage Vth of the driver transistor 22 of each pixel changes due to a variation in manufacturing processes of the driver transistor 22 and a deterioration in time, the drain-source-current Ids will not change and an emission luminance of the organic EL element 21 will not change.

(Principle of Mobility Correction)

Figure 8:
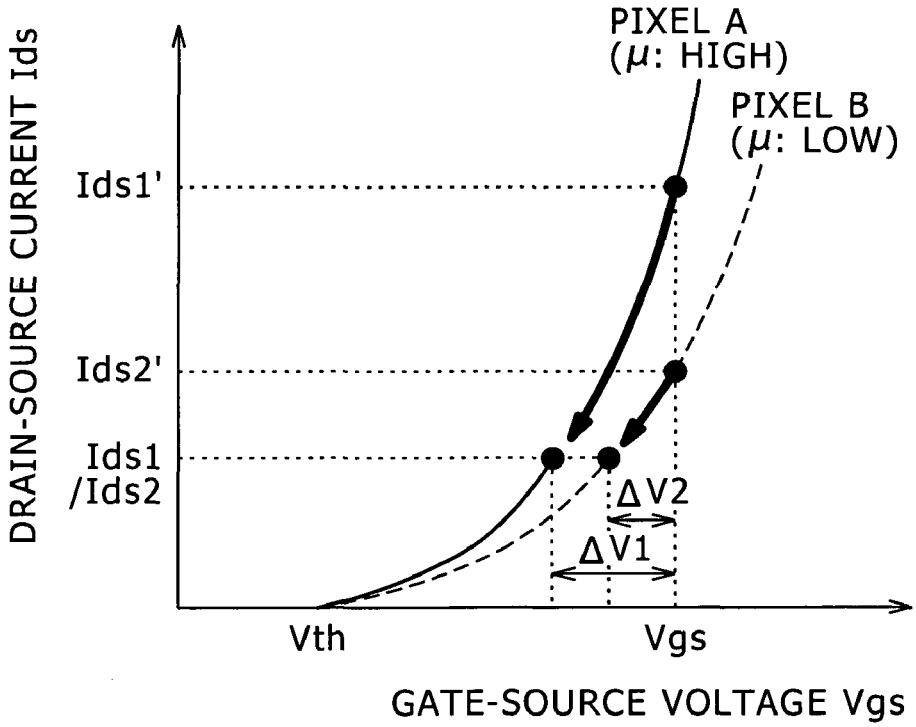
FIG. 8 is a diagram showing the characteristics of a driver transistor explaining an issue associated with a variation of a mobility μ.

A description of the principle of mobility correction of the driver transistor 22 will be given next. FIG. 8 is a diagram showing characteristic curves while comparing a pixel A having a relatively high mobility μ of the driver transistor 22 and a pixel B having a relatively low mobility μ of the driver transistor. If the driver transistor 22 includes a polysilicon thin film transistor or the like, a variation in the mobility μ of each pixel is inevitable, such as in pixels A and B.

If an input signal voltage Vsig of the same level is written in the pixels A and B having a variation in the mobility μ, there is a large difference between a drain-source current Ids1' flowing through the pixel A having a high mobility μ and a drain-source current Ids2' flowing through the pixel B having a low mobility μ. Uniformity of the screen is degraded if there is a large difference between drain-source currents Ids caused by the variation in mobilities μ.

As seen from the transistor characteristic formula (1) described above, the drain-source current Ids becomes large if the mobility μ is high. Therefore, the negative feedback amount ΔV becomes larger as the mobility μ becomes higher. As shown in FIG. 8, a feedback amount ΔV1 of the pixel A having the higher mobility μ is larger than a feedback amount ΔV2 of the pixel B having the lower mobility μ. In the mobility correction operation, the drain-source current Ids of the driver transistor 22 is negatively-fed back to the input signal voltage Vsig side. Since the negative feedback amount becomes large if the mobility μ is high, a variation in the mobility μ can be suppressed.

More specifically, as the pixel A having the high mobility μ is corrected by a feedback amount ΔV1, the drain-source current Ids reduces greatly from Ids1' to Ids1. On the other hand, since a feedback amount ΔV2 for the pixel B having the low mobility μ is small, the drain-source current Ids reduces not so much, but from Ids2' to Ids2. As a result, since the drain-source current Ids1 for the pixel A becomes approximately equal to the drain-source current Ids2 for the pixel B, a variation in the mobility μ can be corrected.

In summary, if there are pixels A and B having different mobilities μ, a feedback amount ΔV1 of the pixel A having a high mobility μ is smaller than a feedback amount ΔV2 of the pixel B having a low mobility μ. In other words, the feedback amount ΔV becomes large for a pixel having a high mobility μ, and a reduction amount of the drain-source current Ids becomes large. Namely, by negatively-feeding back the drain-source current Ids of the driver transistor 22 to the input signal voltage Vsig side, values of the drain-source currents Ids of the pixels having different mobilities μ are made uniform so that a variation in the mobility μ can be corrected.

Figure 9:
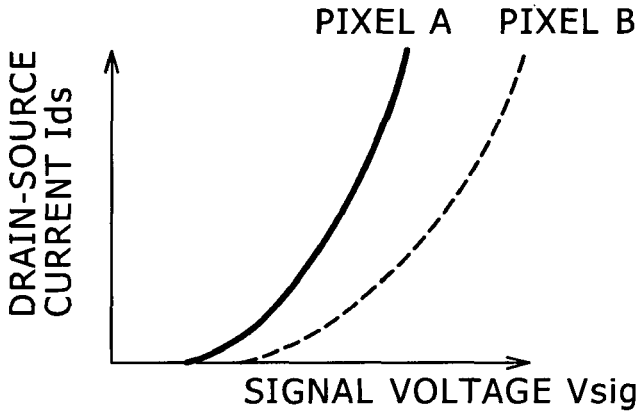
FIGS. 9A to 9C are diagrams showing the characteristics of a relation between a video signal voltage Vsig and a drain-source current Ids of a driver transistor, depending upon the presence/absence of threshold value correction and mobility correction.
Figure 9:
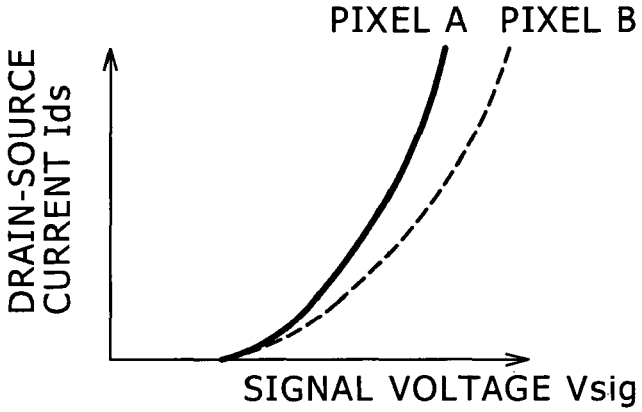
Figure 9:
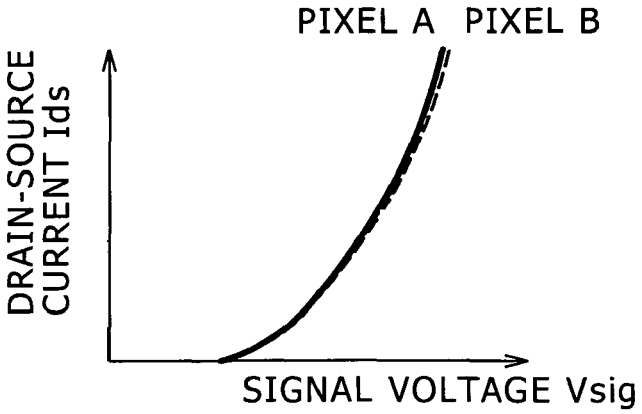

With reference to FIGS. 9A to 9C, a description of a relation between the video signal potential (sampling potential) Vsig and the drain-source current Ids of the drive transistor 22 will be given, in case the threshold value correction and mobility correction are performed or not performed.

FIG. 9A shows the case in which neither the threshold value correction nor the mobility correction is performed; FIG. 9B shows the case in which only the threshold value correction is performed without the mobility correction; and FIG. 9C shows the case in which both the threshold value correction and mobility correction are performed. As shown in FIG. 9A, if neither the threshold value correction nor the mobility correction is performed, there is a large drain-source current Ids difference between the pixels A and B caused by the variation in the threshold values Vth and mobilities μ of the pixels A and B.

In contrast, if the threshold value correction only is performed, as shown in FIG. 9B, there is still a drain-source current Ids difference between the pixels A and B caused by the variation in the mobility μ of the pixels A and B, although a variation in the drain-source current Ids can be reduced to some extent by the threshold value correction. If both the threshold value correction and the mobility correction are performed, as shown in FIG. 9C, the drain-source current Ids difference between the pixels A and B caused by the variation in the threshold voltages Vth and mobilities μ of the pixels A and B can almost be eliminated. Therefore, a luminance variation of the organic EL element 21 will not occur at any tonal level, and a display image of high quality can be obtained.

(Operation and Advantage of Plurality of Power Source Supply Scan Circuits)

Next, a description of the operation and advantage when a plurality of power source supply scan circuits 50 (50A and 50B) are provided, which is the gist of the present invention, will be given.

Figure 10:
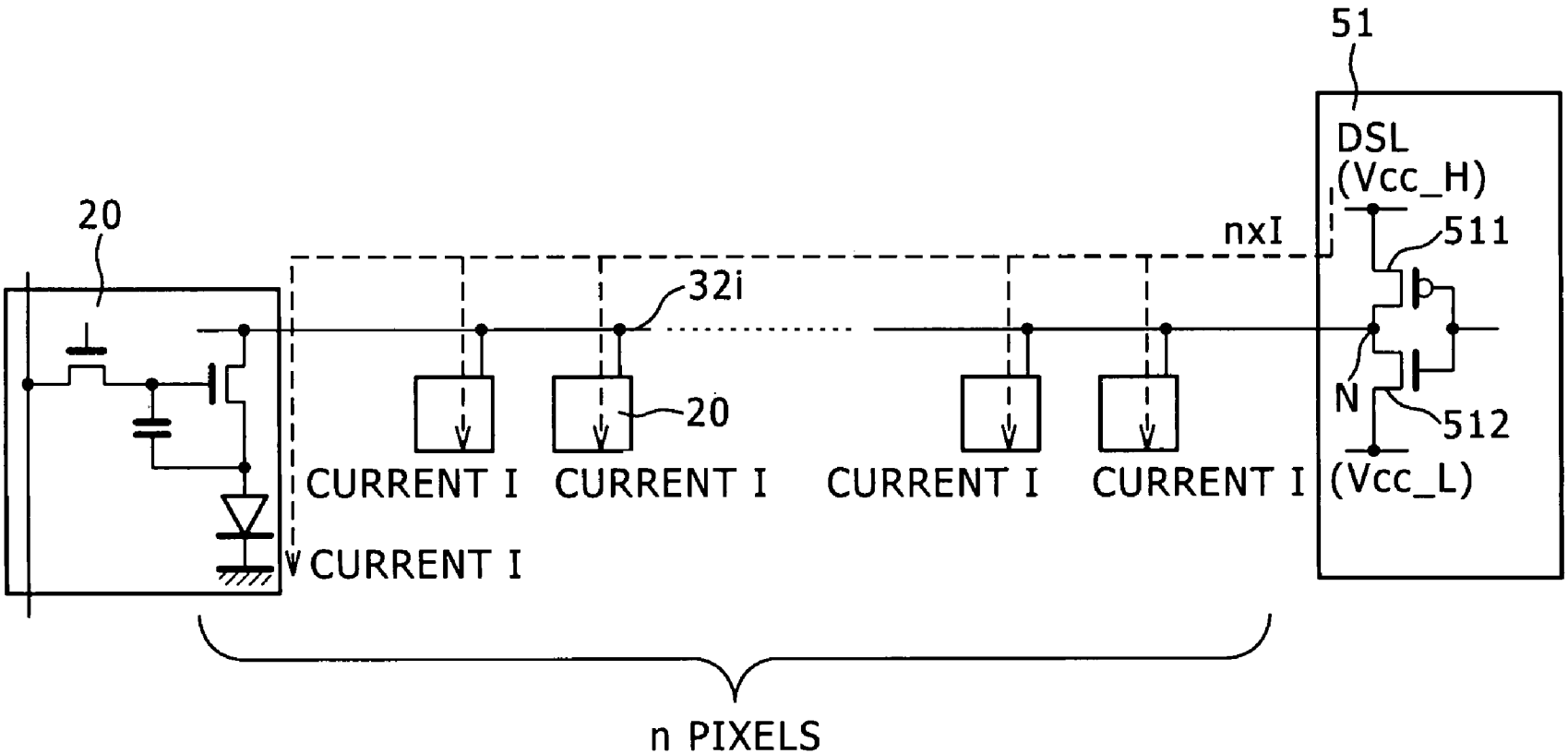
FIG. 10 is a circuit diagram illustrating an operation when one power source supply scan circuit is provided.

First, with reference to FIG. 10, a description of the case in which one power source supply scan circuit 50 is provided will be given. FIG. 10 shows n pixels 20 at the i-th row connected to a power supply line 32*i* at the i-th row and a unit circuit 51 corresponding to the i-th row of the power source supply scan circuit 50.

The organic EL element 21 is an electro-optical element of a current drive type changing an emission luminance in response to the value of current flowing through the element. The current source for the organic EL element 21 during pixel emission is the power supply line 32*i* used as a power source path. Therefore, an output stage of the unit circuit 51 has a CMOS inverter structure (buffer structure) connected serially between the first potential Vcc_H and second potential Vcc_L and constituted of a p-channel MOS transistor 511 and an n-channel MOS transistor 512 whose gates are connected in common. One end of the power supply line 32*i* is connected to an output node N of the CMOS inverter.

Figure 12:
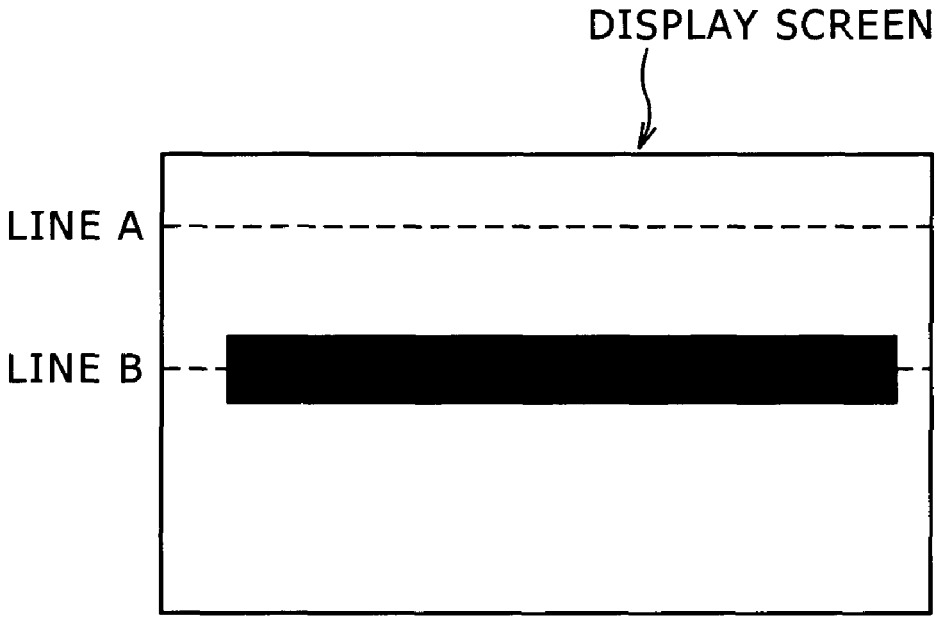
FIG. 12 is a diagram illustrating an issue in an embodiment of the present invention.

Consider now that an image having luminance levels greatly different at respective lines is displayed, for example, a black stripe such as shown in FIG. 12 is displayed in a partial area of the display screen. When the image such as shown in FIG. 12 is displayed, a total current (n×I), where I is the current flowing through the pixel 20, flowing through respective current supply lines 32 becomes different between the lines A and B because the luminance levels at the lines A and B differ greatly.

If the total current (n×I) necessary for emission of the organic EL elements 21 becomes different at each video line, a voltage drop in the p-channel MOS transistor 511 of the unit circuit 51 of the buffer structure of the power source supply scan circuit 50 becomes different at each video line. If the voltage drop in the MOS transistor 511 becomes different at each video line, the power supply lines 32-1 to 32-*m* have a potential difference. Therefore, a drain voltage of the driver transistor 22 becomes different at each line so that the channel length modulation effect occurs corresponding to the early effect of a bipolar transistor. A luminance difference therefore is formed at each video line.

In the organic EL display device 10 of this embodiment, therefore, for example, two power source supply scan circuits 50A and 50B are disposed on both sides of the pixel array unit 30 by sandwiching the unit. The first potential Vcc_H and second potential Vcc_L used as power supply line potentials DSL1 to DSLm are supplied to the power supply lines 32-1 to 32-*m* from both sides of the pixel array unit 30.

Figure 11:
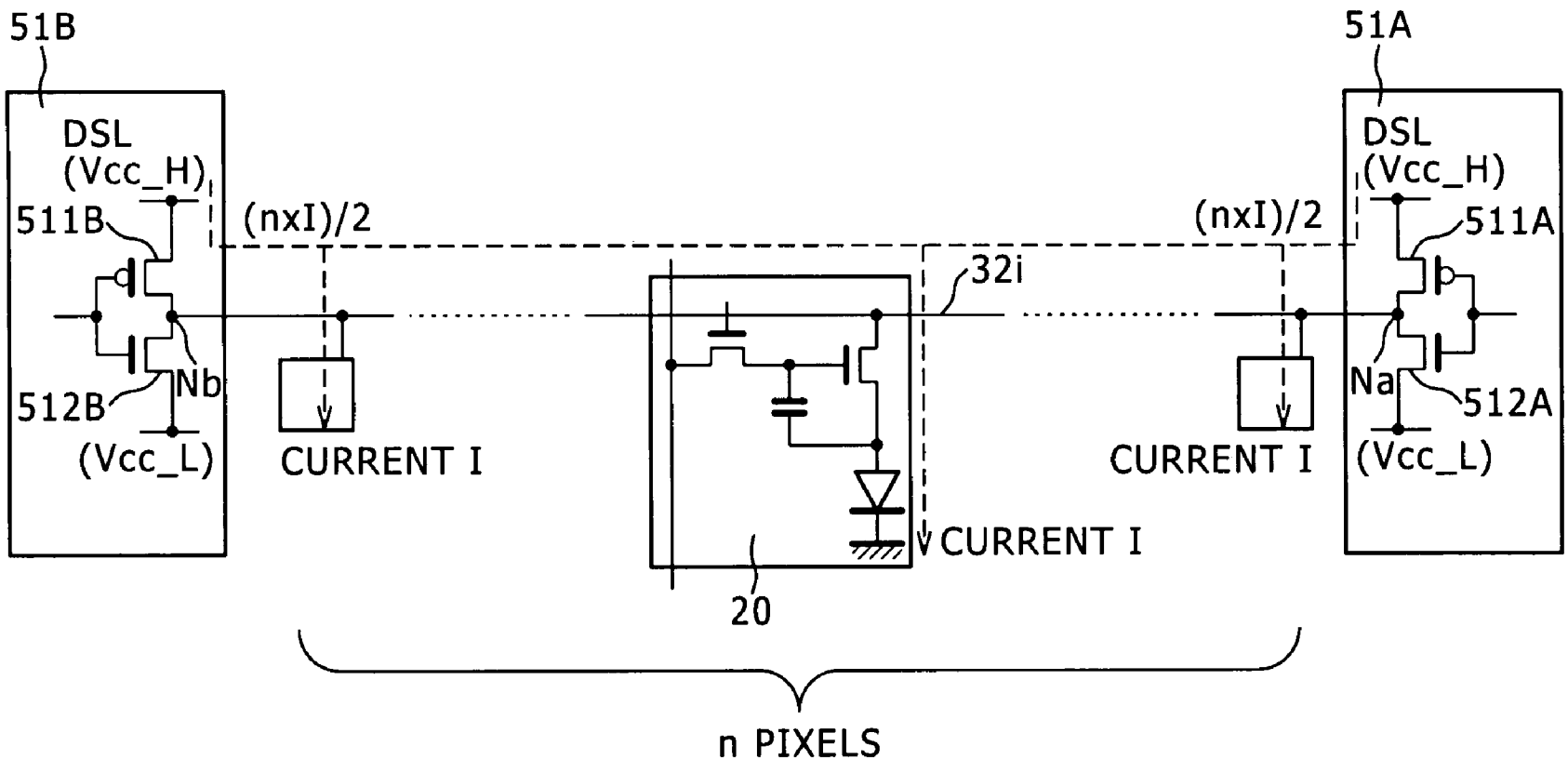
FIG. 11 is a circuit diagram illustrating an operation when two power source supply scan circuits are provided.

FIG. 11 shows n pixels 20 at the i-th row connected to a power supply line 32*i* at the i-th row, and unit circuits 51A and 51B corresponding to the i-th row of the power source supply scan circuits 50A and 50B.

An output stage of the unit circuit 51A has a CMOS inverter structure (buffer structure) connected serially between the first potential Vcc_H and second potential Vcc_L and constituted of a p-channel type MOS transistor 511A and an n-channel type MOS transistor 512A whose gates are connected in common. Similarly, an output stage of the unit circuit 51B has a buffer structure connected serially between the first potential Vcc_H and second potential Vcc_L and constituted of a p-channel type MOS transistor 511B and an n-channel type MOS transistor 512B whose gates are connected in common. Both output nodes Na and Nb are connected to opposite ends of the power supply line 32*i*.

For example, two power source supply scan circuits 50A and 50B are disposed divisionally on both sides of the pixel array unit 30, and the first potential Vcc_H and the second potential Vcc_L are supplied to the power supply lines 32-1 to 32-*m* from both sides of the pixel array unit 30. As compared to one power source supply scan circuit 50 disposed on one side of the pixel array unit 30, it is sufficient if each of the power source supply scan circuits 50A and 50B supplies a half of the current, i.e., (n×I)/2 necessary at each video line to the power supply lines 32-1 to 32-*m*.

It is possible to halve the current to be supplied from each of the power source supply scan circuits 50A and 50B to the power supply lines 32-1 to 32-*m*. It is therefore possible to reduce a voltage drop in the p-channel type MOS transistors 511A and 511B of the unit circuits 51A and 51B of the buffer structure. Thus, a luminance difference between video lines that is caused by a difference between total currents flowing through the power supply lines 32-1 to 32-*m*, which is necessary for emission of the organic EL elements 21 therefore can be reduced. Namely, even if a difference of current required for the emission of light at each video line is caused, a luminance difference at each video line caused by the current difference can be reduced so that an image of high quality can be displayed.

If the ratio of W (channel width)/L (channel length) of the p-channel type MOS transistors 511A and 511B of the unit circuits 51A and 51B of the buffer structure is set larger than the ratio of W/L of a p channel type MOS transistor 511 of a single power source supply scan circuit 50 to lower on-resistance, the voltage drop in the p-channel type MOS transistors 511A and 511B can be lowered and an issue of a luminance difference at each video line can be settled effectively.

In this embodiment, the two power source supply scan circuits 50A and 50B are disposed on both sides of the pixel array unit 30, by sandwiching the pixel array unit. However, it is not necessarily required that the power source supply scan circuits be disposed on both sides of the pixel array unit 30 but the two power source supply scan circuits 50A and 50B may be disposed on one side of the pixel array unit 30. Also, in this case, since it is possible to halve the current to be supplied from each of the power source supply scan circuits 50A and 50B to the power supply lines 32-1 to 32-*m*, a luminance difference between video lines can be reduced, the difference being caused by a difference of a total current flowing through the power supply lines 32-1 to 32-*m*, which is necessary for emission of the organic EL elements 21.

However it is preferable not to adopt the structure in which the two power source supply scan circuits 50A and 50B are disposed on one side of the pixel array unit 30 but the structure in which the circuits are disposed on both sides of the pixel array unit 30, from the viewpoint of a transmission delay caused by wiring resistance and parasitic capacitance of the power supply lines 32-1 to 32-*m*.

More specifically, there is a delay of the power source potential DSL outputted from the power source supply scan circuits 50A and 50B due to the wiring resistance and parasitic capacitance of the power supply lines 32-1 to 32-*m*. This delay becomes larger as positions become distant from the power source supply scan circuits 50A and 50B. Therefore, when the two power source supply scan circuits 50A and 50B are disposed at one side of the pixel array unit 30, the delay on the opposite (another) side of the power source supply scan circuits 50A and 50B in the pixel array unit 30 becomes maximum, and a difference becomes large between a delay amount on one side and a delay amount on the other side, and thus an operation timing of a pixel on one side and an operation timing of a pixel on another side differs significantly.

In contrast, if the two power source supply scan circuits 50A and 50B are disposed on both sides of the pixel array unit 30, although the delay becomes maximum in a central part of the pixel array unit 30, a difference between a delay on one side and a delay in the central area is very small as compared to a difference between a delay amount on one side and a delay amount on another side when the circuits are disposed on one side of the pixel array unit 30. It is therefore possible to reduce a difference between pixel operation timings in the right/left direction of the pixel array unit 30.

The number of power source supply scan circuits 50 is not limited to two. As the number thereof is larger, current to be supplied from each of power source supply scan circuits to the power supply lines 32-1 to **32-*m* can be made small. Thus, the effect of a small current is large on reducing a luminance difference between video lines caused by a difference of the total current necessary for emission of the organic EL elements 21**.

Although the embodiment is applied to the organic EL display device using an organic EL element as an electro-optical element of the pixel circuit 20, embodiments of the present invention are not limited thereto, and the embodiment is applicable to a general display device using an electro-optical element (light emitting element) of a current drive type in which an emission luminance changes in response to a value of current flowing through the device.

[Examples of Applications]

The display device in embodiments of the present invention described above is applicable to various electronic apparatuses shown in FIGS. 10 to 14 in all fields, in which a video signal inputted to an electronic apparatus or generated in an electronic apparatus is displayed as images or pictures, such as a digital camera, a note type personal computer, a portable terminal apparatus, such as mobile phone, and a video camera. A description of examples of an electronic apparatus to which embodiments of the present invention is applicable will be given.

The display device of an embodiment of the present invention may include sealed and module type devices, such as a display module formed by bonding the pixel array unit 30 to an opposing surface of transparent glass or the like. A color filter, a protective film, the light shielding film or the like may be layered on the transparent opposing surface. The display module may have a circuit unit, a flexible print circuit (FPC) and the like for inputting/outputting a signal between an external to the pixel array unit.

Figure 13:
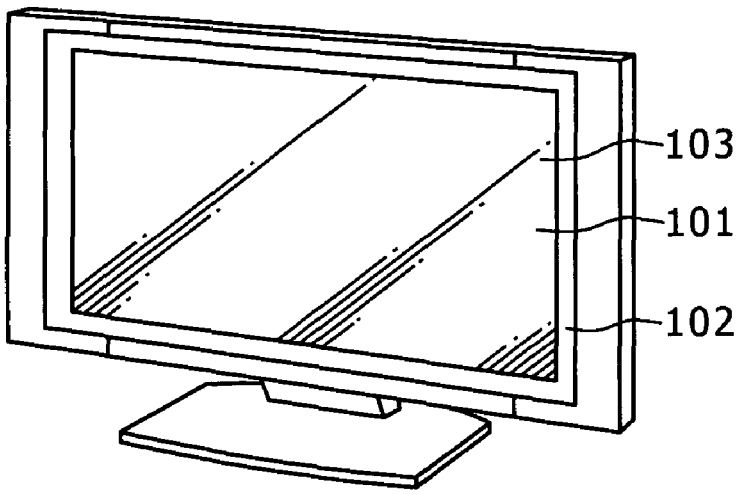
FIG. 13 is a perspective view of a television set to which the present invention is applied.

FIG. 13 is a perspective view of a television set to which the display device of an embodiment of the present invention is applied. The television set in this embodiment of an application example includes an image display screen 101 having a front panel 102, a filter glass 103 and the like. The image display screen 101 is formed by using the display device of embodiments of the present invention.

Figure 14A:
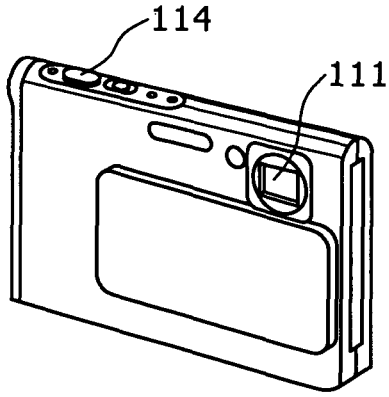
FIGS. 14A and 14B are perspective views of a digital camera to which the present invention is applied.
Figure 14B:
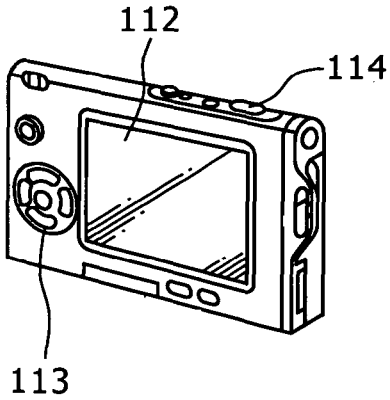

FIGS. 14A and 14B are perspective views of a digital camera to which the display device in an embodiment of the present invention is applied. FIG. 14A is a perspective view as viewed from the front side; and FIG. 14B is a perspective view as viewed from the back side. The digital camera of this application example includes an emission unit for flashing 111, a display unit 112, a menu switch 113, a shutter button 114 and the like. For the display unit 112, the display device of embodiments of the present invention is utilized.

Figure 15:
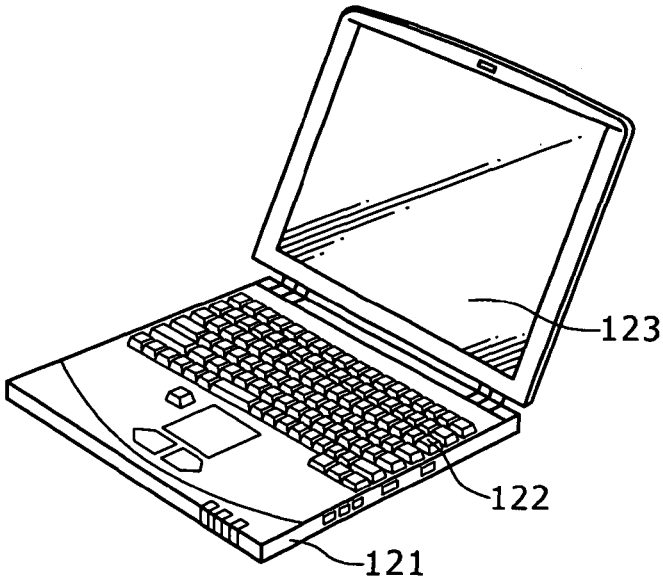
FIG. 15 is a perspective view of a note type personal computer whereto the present invention is applied.

FIG. 15 is a perspective view of a note type personal computer to which embodiments of the present invention is applied. The note type personal computer of this application example includes a main unit 121 having a keyboard 122 for entering characters or the like, a display unit 123 for displaying an image, and the like. For the display unit 123, the display device of embodiments of the present invention is utilized.

Figure 16:
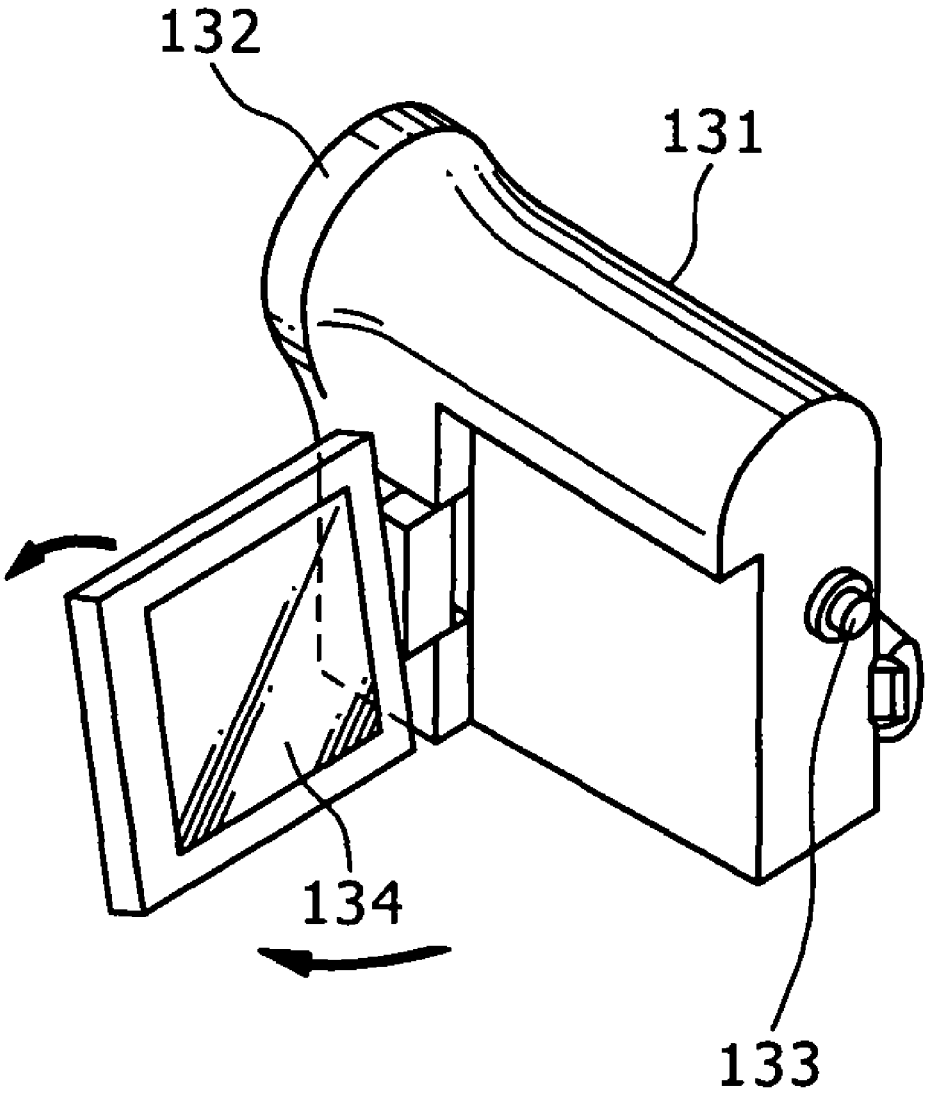
FIG. 16 is a perspective view of a video camera to which the present invention is applied.

FIG. 16 is a perspective view of a video camera to which the display device of the present invention is applied. The video camera of this application example has a main unit 131, a lens 132 facing the front side for taking an object, a start/stop switch 133 to be used during photographing, a display unit 134 and the like. The display unit 134 is formed by using the display device of embodiments of the present invention.

Figure 17:
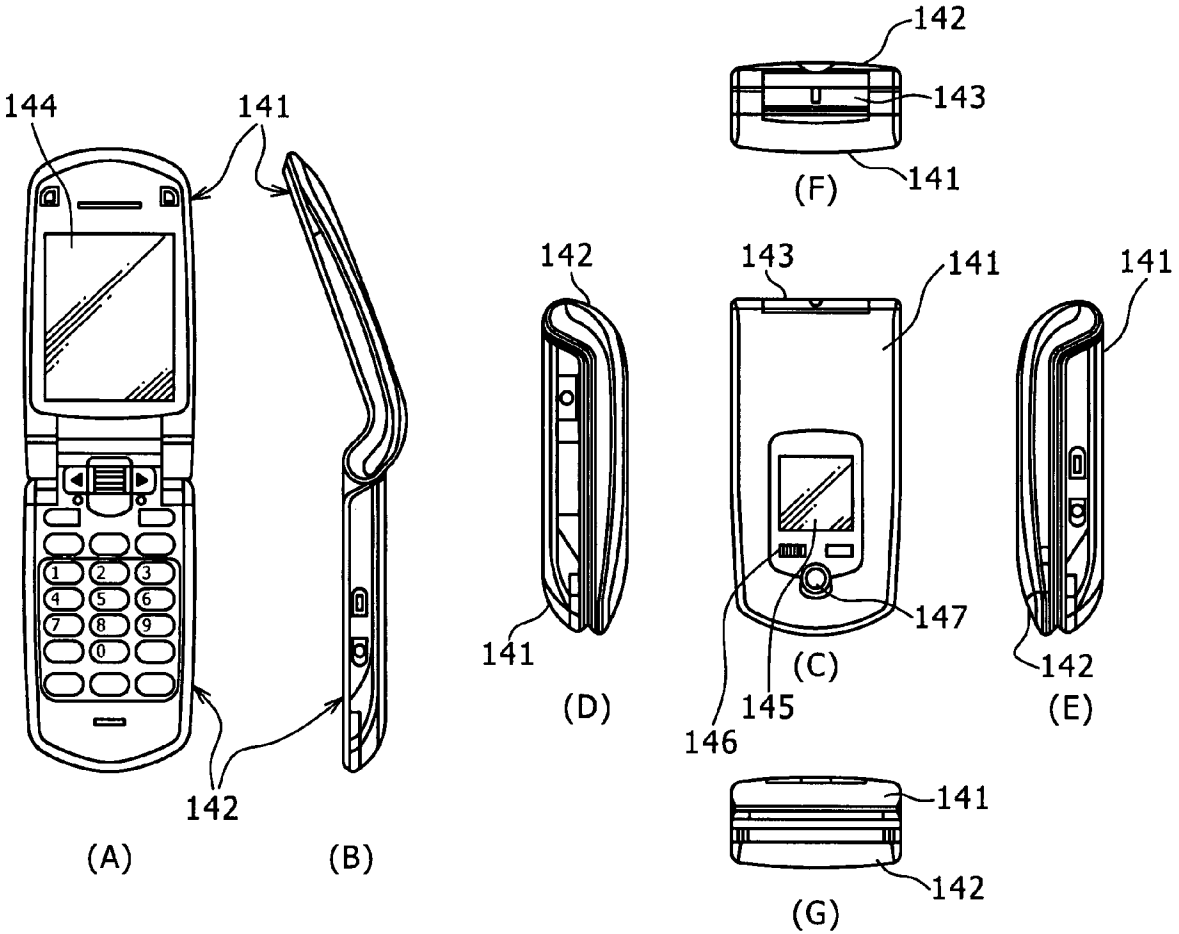
FIGS. 17A to 17G are diagrams showing a mobile phone to which the present invention is applied.

FIGS. 17A to 17G show a portable terminal apparatus, e.g., a mobile phone, to which the display device of the present invention is applied. FIG. 17A is a front view in an open state; FIG. 17B is a side view; FIG. 17C is a plan view in a close state; FIG. 17D is a left side view; FIG. 17E is a right side view; FIG. 17F is a view as viewed from top; and FIG. 17G is a view as viewed from the bottom. The mobile phone of this application example has an upper housing 141, a lower housing 142, a coupling unit (hinge unit) 143, a display 144, a sub-display 145, a picture light 146, a camera 147 and the like. For the display 144 and the sub-display 145, the display device of embodiments of the present invention is used.

According to the present invention, by lowering a voltage drop generated in the power source supply scan circuit due to current to be supplied to pixels in the row unit basis, a luminance difference at each video line caused by the current difference may be reduced even if a difference is caused in currents necessary for emission at video lines. It is therefore possible to display an image of high quality.

It should be understood by those skilled in the art that various modifications, combinations, subcombinations and alterations may occur depending on design requirements and other factors insofar as they are within the scope of the appended claims or the equivalents thereof.

What is claimed is:

1. A display device comprising:

a pixel array unit having pixels disposed in a matrix shape, each pixel including an electro-optical element, a write transistor for sampling and writing an input signal voltage provided from a signal line placed at a signal voltage or a reference potential, a holding capacitor for holding the signal voltage written by the write transistor, and a driver transistor for driving the electro-optical element in response to the signal voltage held in the holding capacitor;

a scan circuit for selectively scanning each pixel in the pixel array unit at a row unit basis; and a plurality of power source supply scan circuits for selectively supplying a first potential and a second potential lower than the first potential to a power supply line to supply current to the driver transistors, synchronously with line sequential scanning by the scan circuit, wherein, at a beginning of line sequential scanning, the second potential is lower than the reference potential at the signal line; and wherein the plurality of power source supply scan circuits are disposed on both sides of the pixel array unit by sandwiching the pixel array unit, and one of the plurality of power source supply scan circuits is disposed between the pixel array unit and the scan circuit.

2. The display device according to claim 1, wherein the driver transistor is initialized for a threshold voltage correction operation by setting a gate of the driver transistor as the reference potential and setting a source of the driver transistor as the second potential.

3. A driving method for use in a display device comprising a scan circuit, a plurality of power source supply scan circuits, and a pixel array unit having pixels disposed in a matrix shape, a write transistor for sampling and writing an input signal voltage provided from a signal line placed at a signal voltage or a reference potential, a holding capacitor for holding the signal voltage written by the write transistor, and a driver transistor for driving the electro-optical element in response to the signal voltage held in the holding capacitor, the method comprising:

selectively scanning each pixel in the pixel array unit on a row unit basis; and selectively supplying a first potential and a second potential lower than the first potential as power source potential to a power supply line to supply current to the driver transistors, synchronously with line sequential scanning by the scan circuit wherein, at a beginning of line sequential scanning, the second potential is lower than the reference potential at the signal line; and wherein the plurality of power source supply scan circuits are disposed on both sides of the pixel array unit by sandwiching the pixel array unit, and one of the plurality of power source supply scan circuits is disposed between the pixel array unit and the scan circuit.

4. The driving method according to claim 3, wherein the driver transistor is initialized for a threshold voltage correction operation by setting a gate of the driver transistor as the reference potential and setting a source of the driver transistor as the second potential.

5. An electronic apparatus having a display device the display device comprising:

a pixel array unit having pixels disposed in a matrix shape, each pixel including an electro-optical element, a write transistor for sampling and writing an input signal voltage provided from a signal line placed at a signal voltage or a reference potential, a holding capacitor for holding the signal voltage written by the write transistor, and a driver transistor for driving the electro-optical element in response to the signal voltage held in the holding capacitor;

a scan circuit for selectively scanning each pixel of the pixel array unit on a row unit basis; and a plurality of power source supply scan circuits for selectively supplying a first potential and a second potential lower than the first potential to a power supply line to supply current to the driver transistors, synchronously with line sequential scanning by the scan circuit wherein, at a beginning of line sequential scanning, the second potential is lower than the reference potential at the signal line; and wherein the plurality of power source supply scan circuits are disposed on both sides of the pixel array unit by sandwiching the pixel array unit, and one of the plurality of power source supply scan circuits is disposed between the pixel array unit and the scan circuit.

6. The electronic apparatus according to claim 5, wherein the driver transistor is initialized for a threshold voltage correction operation by setting a gate of the driver transistor as the reference potential and setting a source of the driver transistor as the second potential.

* * * * *